US008895825B2

(12) United States Patent
Antaki

(10) Patent No.: US 8,895,825 B2
(45) Date of Patent: Nov. 25, 2014

(54) METHODS AND DEVICES FOR MUTING A HARMONICA

(71) Applicant: James F. Antaki, Allison Park, PA (US)

(72) Inventor: James F. Antaki, Allison Park, PA (US)

( * ) Notice: Subject to any disclaimer, the term of this patent is extended or adjusted under 35 U.S.C. 154(b) by 0 days.

(21) Appl. No.: 13/866,243

(22) Filed: Apr. 19, 2013

(65) Prior Publication Data

US 2013/0276615 A1 Oct. 24, 2013

Related U.S. Application Data

(60) Provisional application No. 61/635,958, filed on Apr. 20, 2012.

(51) Int. Cl.
*G10D 3/12* (2006.01)
*G10D 7/12* (2006.01)

(52) U.S. Cl.
CPC ..... *G10D 7/123* (2013.01)
USPC ..... 84/377

(58) Field of Classification Search
CPC ..... G10D 7/123
USPC ..... 84/377
See application file for complete search history.

(56) References Cited

U.S. PATENT DOCUMENTS

| | | | | | |
|---|---|---|---|---|---|
| 463,034 | A * | 11/1891 | Foote et al. | 84/377 |
| 577,219 | A * | 2/1897 | Weiss | 84/377 |
| 797,232 | A * | 8/1905 | Schwarz | 84/330 |
| 1,285,747 | A * | 11/1918 | Laukandt | 84/377 |
| 2,407,312 | A * | 9/1946 | Magnus | 84/377 |
| 2,496,511 | A * | 2/1950 | Abbott | 84/377 |
| 2,811,070 | A * | 10/1957 | Fitzgerald | 84/378 |
| 2,877,679 | A * | 3/1959 | Machino | 84/377 |
| 2,945,408 | A * | 7/1960 | Terlinde | 84/743 |
| 4,228,720 | A * | 10/1980 | Vidler | 84/377 |
| 4,545,277 | A * | 10/1985 | Strnad | 84/723 |
| 6,291,751 | B1 * | 9/2001 | Antaki | 84/377 |
| 7,091,408 | B2 * | 8/2006 | Thibodeau | 84/377 |
| 8,664,503 | B2 * | 3/2014 | Antaki | 84/483.2 |
| 2013/0276615 | A1 * | 10/2013 | Antaki | 84/377 |

* cited by examiner

*Primary Examiner* — Robert W Horn
(74) *Attorney, Agent, or Firm* — Gwen R. Acker Wood; Acker Wood IP Law, LLC

(57) ABSTRACT

The present invention provides methods and devices for attenuating sound emanating from a harmonica when played while practicing or performing by a player. The methods and devices include a sound blocking and reflecting means and, optionally, a sound absorbing means.

15 Claims, 7 Drawing Sheets

Fig. 1 - Prior Art

METHODS AND DEVICES FOR MUTING A HARMONICA

CROSS REFERENCE TO RELATED APPLICATIONS

The present application claims priority to U.S. Provisional Patent Application No. 61/635,958, filed Apr. 20, 2012, which is incorporated by reference herein in its entirety.

FIELD OF THE INVENTION

The invention relates to muting of musical instruments and, in particular, to attenuating the sound emanating from a harmonica when playing the harmonica.

BACKGROUND OF THE INVENTION

The harmonica is a popular handheld musical instrument that appeals to a wide range of players from children to seniors, amateurs to professionals. Also called a harp, French harp, blues harp or mouth organ, the harmonica is a free reed wind instrument used primarily in blues and American folk music, jazz, country and rock and roll.

One popular form of the harmonica is the ten-hole diatonic harmonica, having two reeds per hole, although there are numerous variations having different numbers of holes, and reeds per hole. As shown for example in FIG. 1, the typical construction of a diatonic harmonica 1 includes a pair of reed plates 4, 5 attached to opposing faces of a comb 2 defining an air chamber 3 there between. Each reed plate 4, 5 contains a set of flexible elastic reeds 7, 10 each affixed below rectangular slots 6, 9 through which the metallic reeds 7, 10 vibrate. The means of attachment of the elastic reeds 7, 10 to the reed plate 4, 5 may be a rivet, screw, spot weld or any other appropriate attachment means 8. The elastic reeds may be typically made from a variety of alloys including beryllium copper, phosphor bronze, brass, or stainless steel, although they may also be made from polymeric materials.

Harmonicas produce musical tones by a player blowing air into, or drawing air from, a mouthpiece containing multiple holes (or reed chambers) in a manner that causes one or more of the reeds 7, 10 therein to vibrate. The reeds 7, 10 of each reed chamber are configured such that one reed 7 is preferably played when blowing and the other reed 10 when drawing. Surrounding the reeds 7, 10 is an enclosure typically comprised of a pair of cover plates 11, 12 fashioned from metal, plastic, or wood, and providing an opening 15 to the atmosphere, usually positioned on the face of the harmonica opposite the player's mouth, downwind of the air flow.

In a non-limiting example of the operation of the harmonica, the player blows into the air chamber 3 causing the blow reed 7 to close, obstructing the reed slot 6, thereby interrupting the flow of air 14. This flow interruption causes intermittent compression and rarefaction of the air, creating acoustic sound that exits the opening 15 provided by the cover plates 11, 12 which transmit an acoustic pressure to the surrounding air, whereupon it may be perceived by the ear of a person within proximity to the instrument.

When practicing or playing for personal pleasure, however, it may be desirable to prevent the sound from being perceived by persons other than the player so as not to disturb others or to bring unwanted attention to the player.

Further, it may be undesirable or disadvantageous for the player to simply play less forcefully, as a certain minimum air flow is necessary for the instrument to operate property.

A need exists, therefore, for a way to attenuate the loudness of a harmonica so as to permit playing or practicing the instrument without disturbing others.

SUMMARY OF THE INVENTION

The present invention fulfills this need by providing methods and devices for attenuating sound produced when playing a harmonica.

In one aspect of the present invention, there is provided a method for attenuating sound of a harmonica, comprised of providing a sound blocking and reflecting means and, optionally, providing a sound absorbing means.

In one embodiment, the sound blocking and reflecting means includes upper and lower enclosures which surround reed plates of a harmonica, wherein the enclosures provide a physical barrier to egress of acoustic pressure, and thus attenuates the sound emanating from the harmonica. A sound-absorbing material is provided on interior surfaces of the enclosures.

In another embodiment, the sound and reflecting means includes a tubular portion that protrudes into the upper and lower enclosures of a harmonica, wherein the tubular portion cooperates with the volume of air within the enclosures to create a Helmholtz resonator.

In another embodiment, the sound and reflecting means includes a tubular structure that communicates with the air chamber within the comb of a harmonica, thereby providing a quarter wavelength reflecting means. The length of the tubular structure is adjustable by way of nested tubular sections slideably attached internal or external to one another.

In another aspect of the present invention, there is provided a device for attenuating sound produced from a harmonica, comprised of a sound blocking and reflecting means and, optionally, a sound absorbing means.

In one embodiment, the sound and reflecting means includes baffles or anechoic chambers which cause reflections or destructive interference of acoustic waves.

In another embodiment, the sound and reflecting means includes a secondary enclosure that forms an anechoic chamber external to a first enclosure of a harmonica. The secondary enclosure is attachable to the first enclosure by way of fastening means such as, without limitation, permanent magnets. An air channel or orifice is provided in the secondary enclosure to allow egress of air sufficient to sustain vibration of the reeds of the harmonica. Said air channel or orifice may be positioned at the rear or the side of the secondary enclosure.

BRIEF DESCRIPTION OF THE DRAWINGS

A full understanding of the present invention can be gained from the following detailed description of non-limiting embodiments when read in conjunction with the accompanying drawings in which.

DETAILED DESCRIPTION OF THE INVENTION

Figure 1:
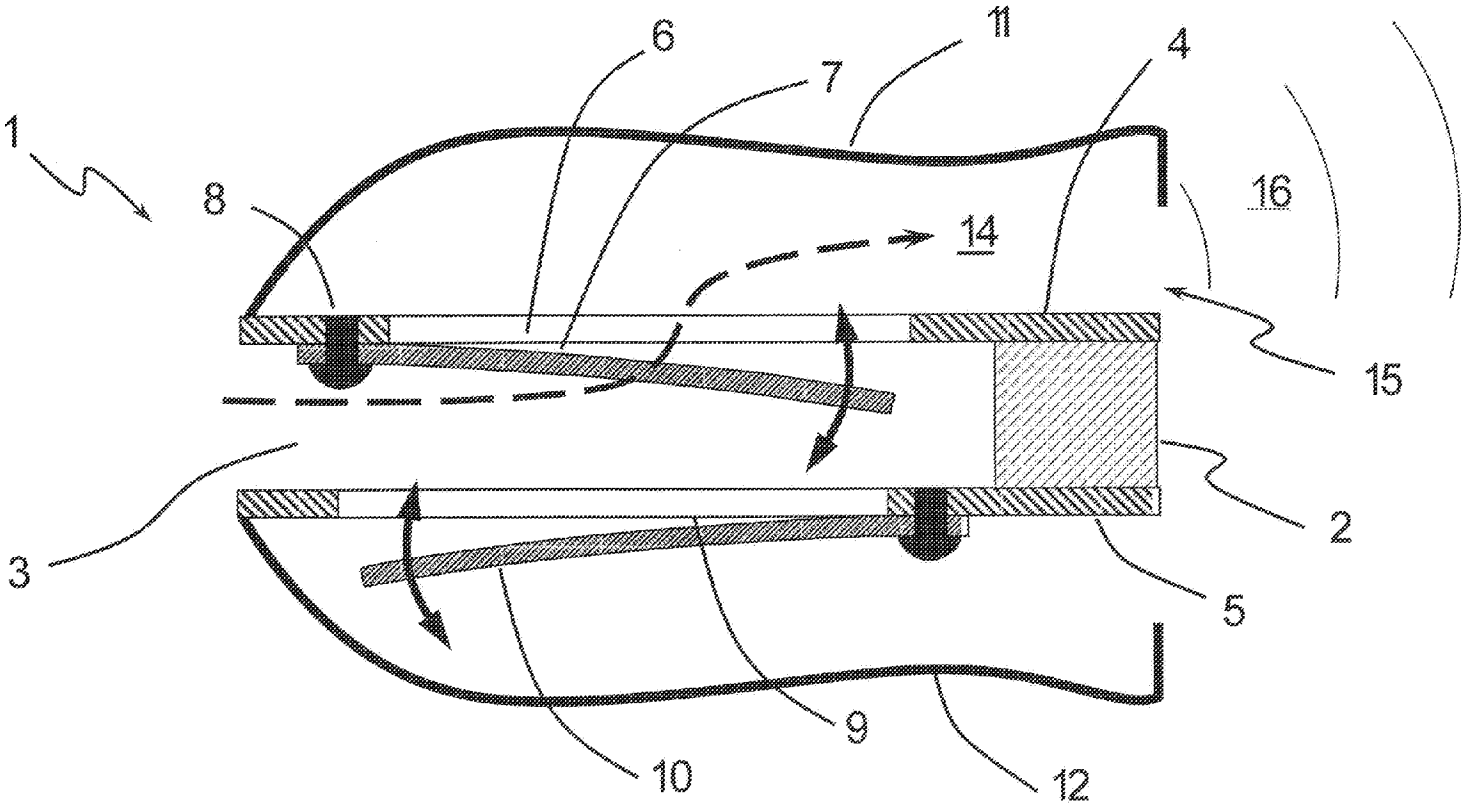
FIG. 1 is cross sectional view of a prior art diatonic harmonica.

A complete understanding of the present invention will be obtained from the following detailed description taken in connection with the accompanying drawing figures, wherein like reference characters identify like parts throughout.

Figure 2:
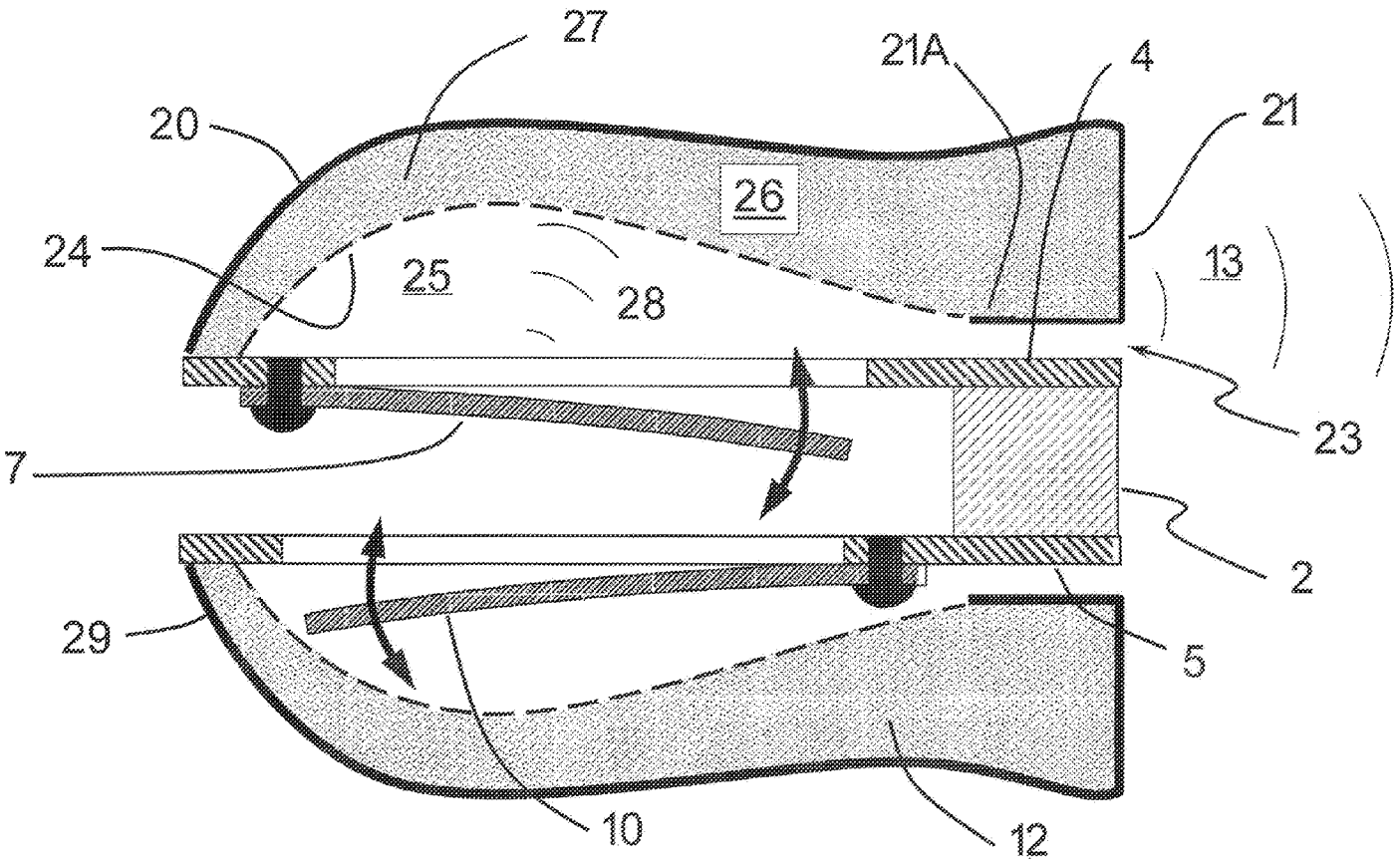
FIG. 2 provides a cross sectional view of a harmonica in accordance with the methods of the invention having an enclosure, sound absorbing material, perforated barrier, and restricted air channel.

Referring now to the drawings, one embodiment of the present invention, as shown in FIG. 2, includes a method for attenuating sound of a harmonica by providing a sound blocking and reflecting means and a sound absorbing means comprised of a comb 2 upon which are fastened reed plates 4, 5 containing flexible reeds 7, 10, providing an upper enclosure 20 having an exterior surface and interior surface, which creates an air chamber 25, and providing sound absorbing material 26 disposed on the interior surface. A perforated barrier 24 may be provided that divides the air chamber into a first chamber 25 and a second chamber 26 which permits transmission of a portion of the acoustic energy 28 from the first air chamber to the second air chamber, wherein reflections further contain and dissipate acoustic energy.

The upper enclosure also includes a rear panel 21 having a portion 21A aligned substantially parallel to the reed plates 4, which in cooperation with the reed plate 4, comprises a transmission channel 23. The combination of the transmission channel 23 and the air chamber 25 comprises a Helmholtz resonator which may further attenuate the egress of acoustic energy by way of destructive interference, while permitting flow of air necessary for sustained oscillation of the reeds 7, 10. In this embodiment, and all subsequent embodiments disclosed herein, the present invention also includes a lower enclosure 29 which is substantially a mirror image of the upper enclosure 20 and which contains the same elements therein as the upper enclosure.

Suitable sound absorbing means for use according to the embodiments of the present invention include, without limitation, open-cell foams such as polyamide foam, wool, or viscoelastic damping material or any other suitable sound absorbing means used by those skilled in the acoustic arts.

In this embodiment, and all subsequent embodiments disclosed herein, the enclosure may be fabricated of a material of suitable mass or density, such as metal alloy, high molecular weight polymer, or ceramic to restrict vibration, hence transmission of sound waves.

Figure 3:
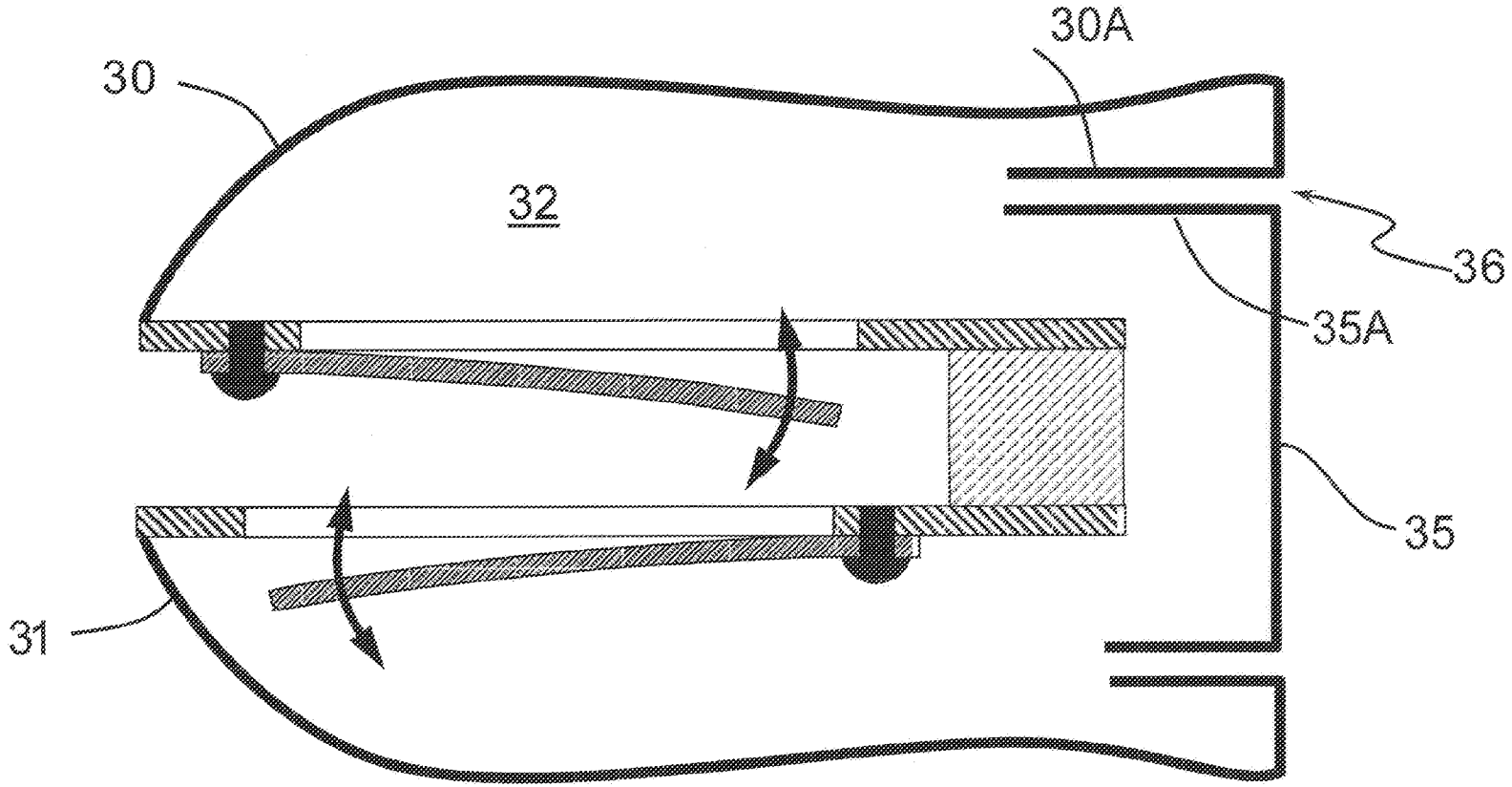
FIG. 3 provides a harmonica in accordance with the methods of the invention having an enclosure with air channels protruding therein.

Another embodiment of the present invention, as shown in FIG. 3, includes a method for attenuating sound of a harmonica by providing a sound blocking and reflecting means comprised of an upper enclosure 30, which creates an air chamber 32, that cooperates with a rear panel 35 having portions 30A, 35A aligned substantially parallel to the reed plate 4 which cooperate to comprise a transmission channel 36. The combination of the transmission channel 36 and the air chamber 32 comprises a Helmholtz resonator in a manner similar to the embodiment described in FIG. 2. The transmission channel may be a rectangular slot or a tubular structure.

Figure 4:
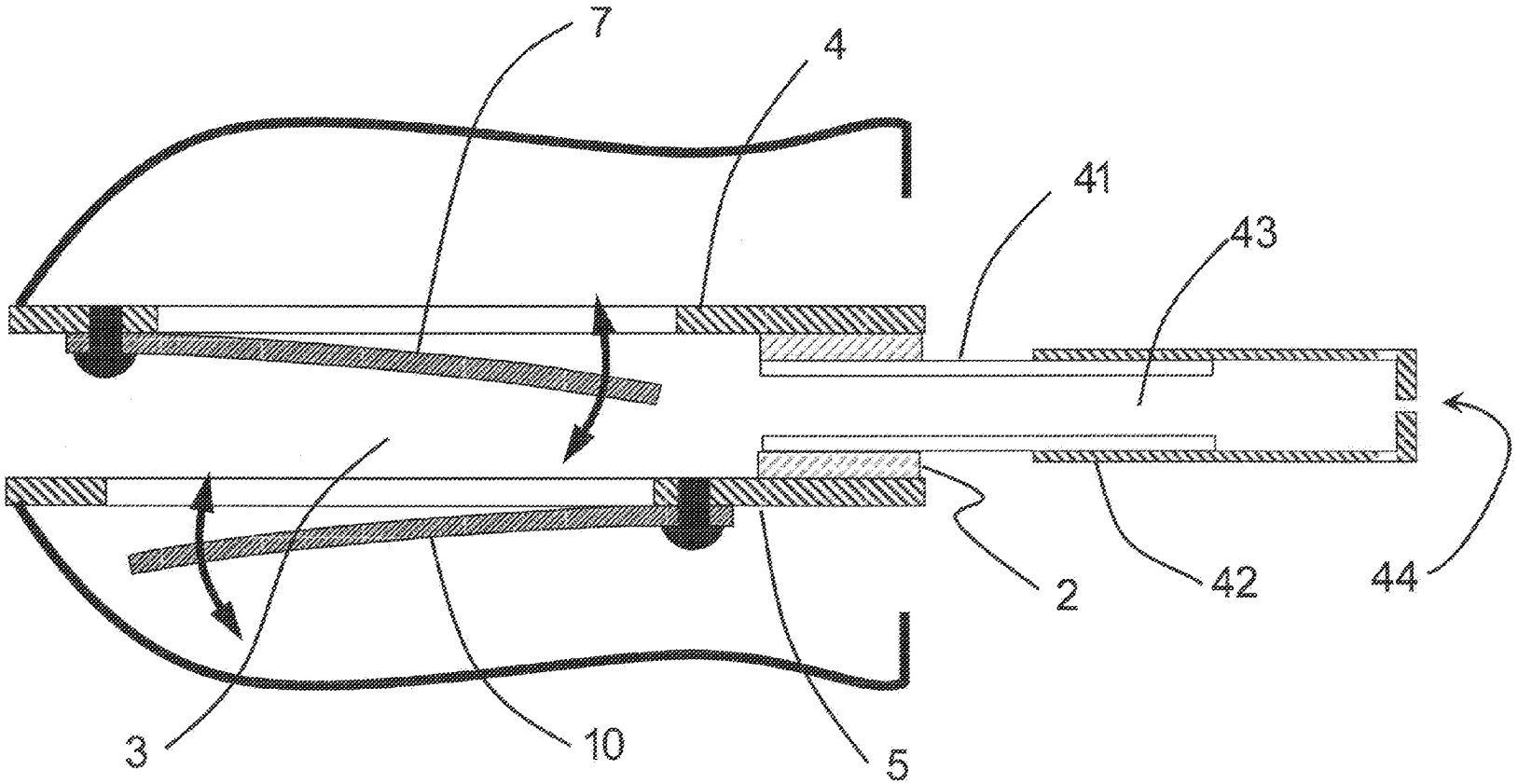
FIG. 4 provides a harmonica in accordance with the methods of the invention having at least one tubular section in communication with the air cavity of the comb of a harmonica.

Another embodiment of the present invention, as shown in FIG. 4, includes a method for attenuating sound of a harmonica by providing a sound blocking and reflecting means comprised of at least one tubular structure 41 comprised of a first tubular section in communication with an air cavity 3 between the reed plates 4, 5. The first tubular section penetrates through the comb 2, providing a quarter-wavelength reflecting means. The length of the tubular structure may be adjustable by way of an independent nested second tubular section 42 telescopically attached internal or external to the first tubular section 41. The second tubular section 42 may be provided with orifice 44 to permit passage of air.

Figure 5:
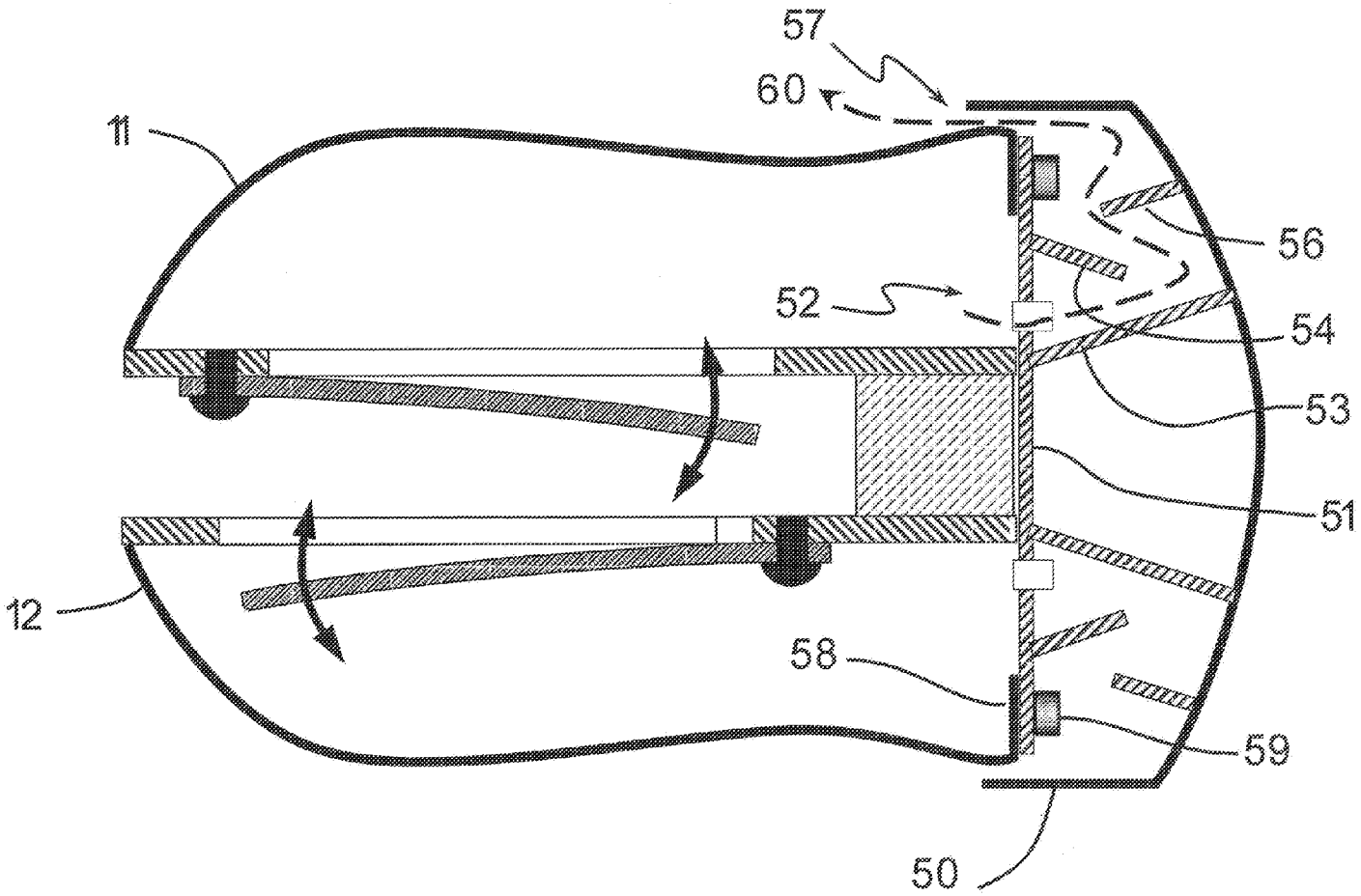
FIG. 5 provides a device in accordance with the invention having baffles within an enclosure that partition air space that interrupt transmission of acoustic waves, yet permit the flow of air.

Another embodiment of the present invention, as shown in FIG. 5, provides a device for attenuating sound of a harmonica that includes a sound blocking and reflecting means. The sound blocking and reflecting means of the device is comprised of an enclosure 50, which is attached to cover plates 11, 12 of the harmonica which may be substantially bowl-shaped, wherein baffles such as 53, 54, 56 are disposed which deflect air flow 60 and interrupt projection of acoustic waves. The device includes a bulkhead plate 51 through which are disposed through-holes 52 to permit passage of air into the cover 50. A gap 57 is provided around the periphery of the cover 50 to permit air 60 to escape therefrom. The gap 57 preferably is directed forward so as to direct the escaping sound to be most effectively perceived by the player. The device is attached to a harmonica by permanent magnets 59 or any suitable attachment means, such as hook-loop fabric, double sided tape, screws, or the like.

Figure 6:
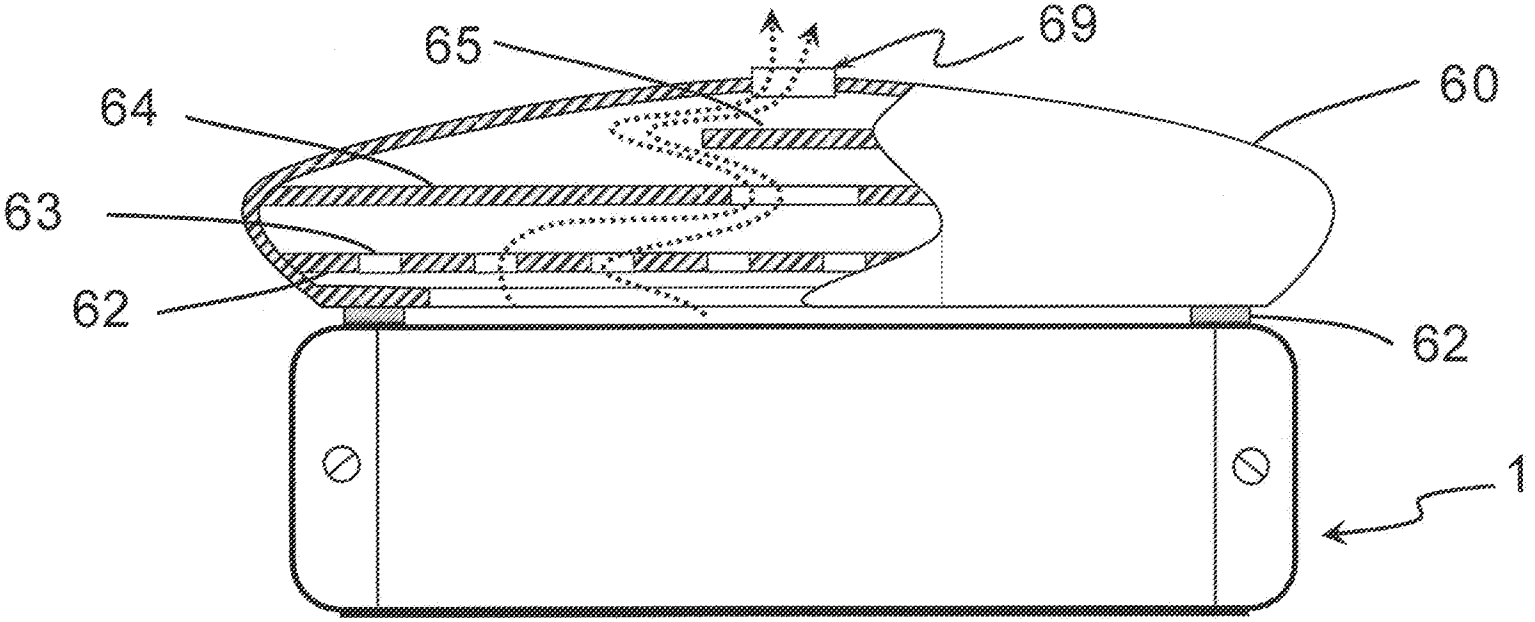
FIG. 6 provides a top view of a device in accordance with the invention that provides a secondary enclosure containing baffles that is attached to the primary enclosure of a harmonica, in which air exits the rear.

Another embodiment of the present invention, as shown in FIG. 6, provides a device for attenuating sound of a harmonica that includes a sound blocking and reflecting means. The sound blocking and reflecting means of the device is comprised of a secondary enclosure 60 that is attachable to the harmonica 1. Disposed within the secondary enclosure 60 are one or more perforated panels, such as 62 and/or baffles, such as 64 and 65, which reflect, interrupt, and/or deflect transmission of acoustic energy. An orifice or passage 69 is provided at the rear of enclosure 60 to permit sufficient egress of air so as to sustain vibration of reeds 7 and/or 10. The device is attached to a harmonica 1 by an adhesive elastomeric tape 61 which provides an air-tight seal with the primary enclosures 20, 29 of the harmonica. It can be appreciated by those skilled in the art that alternative attachment means may be provided by hook-loop fabric, magnets, adhesives, screws, or the like.

Figure 7:
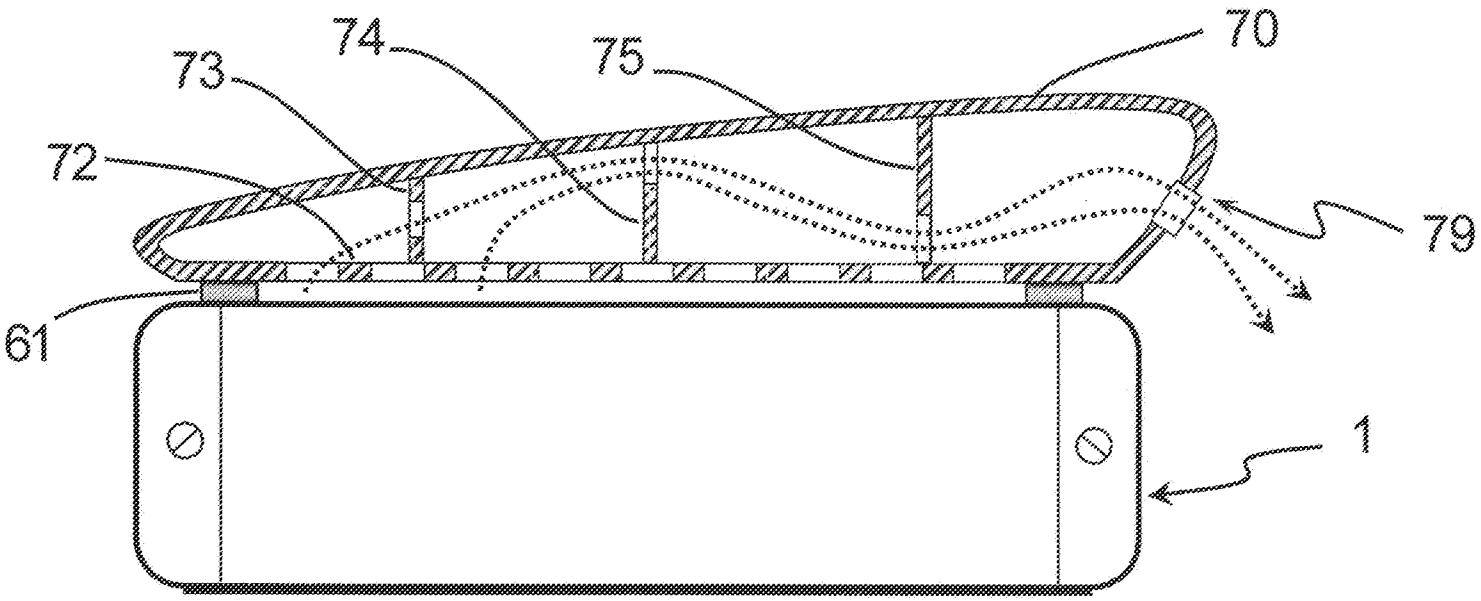
FIG. 7 provides a top view of a device in accordance with the invention that provides a secondary enclosure containing baffles that is attached to the primary enclosure of a harmonica, in which air exits the side.

Another embodiment of the present invention, as shown in FIG. 7, provides a device for attenuating sound of a harmonica that is similar to the embodiment of FIG. 6, but having an orifice 79 at the side so as to direct acoustic energy and air flow laterally. The sound blocking and reflecting means of the device is comprised of a secondary enclosure 70 that is attachable to the harmonica 1. Disposed within the secondary enclosure 70 are one or more perforated panels, such as 72 and/or baffles, such as 73, 74 and 75, which reflect, interrupt, and/or deflect transmission of acoustic energy.

Although the preceding aspects of the invention are described herein with respect to a single pair of reeds, it shall be understood that they may be applied to multiple or all reeds of a harmonica.

It shall be further understood that different aspects of the invention can be implemented individually, collectively or in combination with each other.

It will be appreciated by those skilled in the art that changes could be made to the embodiments described above without departing from the broad inventive concept thereof. It is understood, therefore, that this invention is not limited to the particular embodiments disclosed, but it is intended to cover modifications that are within the spirit and scope of the invention, as defined by the appended claims.

What is claimed is:

1. A method for attenuating sound of a harmonica, comprising:

providing a sound blocking means, a sound reflecting means, and a sound absorbing means.

2. The method according to claim 1, wherein the sound blocking means and the sound reflecting means comprises an upper enclosure and a lower enclosure, each of the enclosures surrounding reed plates of a harmonica that provides a physical barrier to egress of acoustic energy produced when the harmonica is played, each of the enclosures creating an air chamber, wherein each of the enclosures has an exterior surface and an interior surface, wherein the interior surface comprises a perforated barrier that divides the air chamber into a first air chamber and a second air chamber, said perforated barrier permitting transmission of a portion of the acoustic energy from the first air chamber to the second air chamber to attenuate egress of acoustic energy.

3. The method according to claim 2, wherein each of the enclosures has a rear panel, said rear panel having a portion thereof aligned substantially parallel to a reed plate to define a transmission channel therein, wherein the transmission channel and the air chamber produces a Helmholtz resonator which further attenuates egress of acoustic energy.

4. The method according to claim 2, wherein the sound absorbing means comprises a sound absorbing material disposed on the interior surface of the upper enclosure and the lower enclosure, said sound absorbing material selected from the group consisting of open-cell foams such as polyamide foam, wool, viscoelastic damping material and other suitable absorbing material.

5. The method according to claim 1, wherein the sound blocking means and the sound reflecting means comprises an upper enclosure and a lower enclosure that surround reed plates of a harmonica, each of the enclosures creating an air chamber; and a rear panel, said rear panel, said upper enclosure and said lower enclosure each having a portion thereof aligned substantially parallel to a reed plate to define a transmission channel therein, and wherein the combination of the transmission channel and the air chamber comprises a Helmholtz resonator which attenuates egress of acoustic energy.

6. The method according to claim 1, wherein the sound blocking means and the sound reflecting means comprise a tubular structure in communication with an air cavity disposed between reed plates of a harmonica.

7. The method according to claim 6, wherein the tubular structure has a first section and a nested second section telescopically attached to the first section, and wherein the length of the tubular structure is adjustable by moving the second section inward to or outward from the first section.

8. The method according to claim 7, wherein the tubular structure provides a quarter-wavelength reflecting means.

9. The method according to claim 7, wherein the second section nests internally or externally to the first section.

10. A device for attenuating sound of a harmonica, comprising:

a sound blocking means, a sound reflecting means, and a sound absorbing means.

11. The device according to claim 10, wherein the sound blocking means and the sound reflecting means comprises:

a cover attached to an upper enclosure and a lower enclosure of a harmonica, said cover defining a space having one or more baffles disposed therein to deflect air flow and to interrupt projection of acoustic energy; said upper enclosure and lower enclosure each having a rear face aligned substantially perpendicular to a reed plate of the harmonica;

a bulkhead adjacent to the portions of the enclosures that are substantially perpendicular to the reed plates, said bulkhead having one or more through-holes therein to permit passage of air into the cover and attached to the cover by one or more of the baffles;

a gap provided around the periphery of the cover to permit air to escape therefrom; and an attachment means that secures the cover to the harmonica.

12. The device according to claim 11, wherein the gap is directed forwardly to direct escaping sound through the gap to be effectively perceived by a player.

13. The device according to claim 11, wherein the attachment means is selected from the group consisting of magnets, hook-loop fabric, double-sided tape and other suitable attachment means.

14. The device according to claim 10, wherein the sound blocking means and the sound reflecting means comprises:

a secondary enclosure having a first end, a second end and a central orifice, said secondary enclosure defining a space having one or more baffles disposed therein which block, reflect, interrupt and/or deflect transmission of acoustic energy wherein the orifice allows sufficient egress of air to sustain vibration of one or both reeds of a harmonica, said upper enclosure and lower enclosure each having a rear face aligned substantially perpendicular to a reed plate of the harmonica, said first end and said second end of the secondary enclosure each aligned substantially parallel to the rear faces of the upper and lower enclosures; and an attachment means that secures the first end and the second end of the secondary enclosure to the rear faces of the enclosures of the harmonica.

15. The device according to claim 14, wherein the attachment means is selected from the group consisting of a magnet that cooperates with a flange, a hook-loop fabric, double-sided tape, screws and other suitable attachments means.

* * * * *